US008252128B2

(12) United States Patent
Parson et al.

(10) Patent No.: US 8,252,128 B2
(45) **Date of Patent: *Aug. 28, 2012**

(54) ALUMINUM ALLOY AND EXTRUSION

(75) Inventors: Nicholas Charles Parson, Banbury (GB); Barry Roy Ellard, Daventry (GB); Graeme John Marshall, Greatworth (GB)

(73) Assignee: Alcan International Limited, Montreal (CA)

( * ) Notice: Subject to any disclaimer, the term of this patent is extended or adjusted under 35 U.S.C. 154(b) by 697 days.

This patent is subject to a terminal disclaimer.

(21) Appl. No.: 12/075,832

(22) Filed: Mar. 14, 2008

(65) Prior Publication Data

US 2008/0163960 A1 Jul. 10, 2008

Related U.S. Application Data

(63) Continuation of application No. 10/066,442, filed on Feb. 1, 2002, now abandoned, which is a continuation of application No. 09/142,301, filed as application No. PCT/GB97/01040 on Apr. 15, 1997, now Pat. No. 6,375,767.

(30) Foreign Application Priority Data

Apr. 15, 1996 (GB) ..... 9607781.3

(51) Int. Cl.
*C22F 1/04* (2006.01)

(52) U.S. Cl. ..... 148/550; 148/285; 148/518; 148/689; 148/690

(58) Field of Classification Search ..... 148/285, 148/518, 550, 689, 690
See application file for complete search history.

(56) References Cited

U.S. PATENT DOCUMENTS

| | | | |
|---|---|---|---|
| 3,879,194 | A | 4/1975 | Morris et al. |
| 6,375,767 | B1 | 4/2002 | Parson et al. |

FOREIGN PATENT DOCUMENTS

| | | |
|---|---|---|
| GB | 1 136 588 | 12/1968 |
| GB | 1 484 595 | 9/1977 |
| JP | 61-030684 | 2/1986 |

OTHER PUBLICATIONS

Patent Abstracts of Japan, vol. 096, No. 007, Abstract corresponding to Japanese Patent Publication No. 08073973 published Mar. 19, 1996.
Patent Abstracts of Japan, vol. 096, No. 008, Abstract corresponding to Japanese Patent Publication No. 08092684 published Apr. 9, 1996.
Patent Abstracts of Japan, vol. 095, No. 003, Abstract corresponding to Japanese Patent Publication No. 06336682 published Dec. 6, 1994.

*Primary Examiner* — Sikyin Ip
(74) *Attorney, Agent, or Firm* — Cooper & Dunham LLP

(57) ABSTRACT

A population of extrusion billets has a specification such that every billet is of an alloy of composition (in wt. %): Fe<0.35; Si 0.20-0.6; Mn<0.10; Mg 0.25-0.9; Cu<0.015; Ti<0.10; Cr<0.10; Zn<0.03; balance Al of commercial purity. After ageing to T5 or T6 temper, extruded sections can be etched and anodised to give extruded matt anodised sections having improved properties.

16 Claims, 13 Drawing Sheets

ALUMINUM ALLOY AND EXTRUSION

CROSS REFERENCE TO RELATED APPLICATION

This application is a continuation of U.S. patent application Ser. No. 10/066,442 filed Feb. 1, 2002, now abandoned, which is a continuation of U.S. patent application Ser. No. 09/142,301 filed Sep. 4, 1998, now U.S. Pat. No. 6,375,767, as the U.S. national stage of international application No. PCT/GB97/01040 filed Apr. 15, 1997.

Extruded matte anodised sections are made in large quantities for architectural and other use. The aluminium alloys used are 6000 series alloys in the Aluminum Association Register. This invention is concerned with the compositions of the alloys.

The standard production method involves extruding a billet of the chosen alloy, subjecting the extruded section to an alkaline etch, and anodising the resulting matte surface. Studies on the effect of composition on matte etching response have been published and each shows the importance of microstructural features on surface quality. Typically it has been demonstrated that constituent particles, dispersoids and ageing precipitates influence the surface evolution and final appearance. The effects of solid solution content, with the exception of Zn additions, have largely been ignored.

However, there are three important aspects of the aluminium extrudate etching process. Firstly, the extrudate surface finish from the press influences the uniformity of appearance, with a good finish requiring less metal removal to achieve acceptable quality. Secondly, the metal removal rate controls the amount of effluent that has to be controlled and disposed of; hence there are significant environmental benefits to reducing the amount of metal removed for an acceptable finish. Thirdly, the final matte appearance of the extrudate is critical and this means both low gloss (i.e. low brightness) and uniformity.

The benefit of high Fe content to matte finish has been recognised for some time and this has traditionally been used by the aluminium and metal finishing industries. The drawbacks of a high Fe content are: 1) the extrudate surface roughness increases making the product incompatible with others being produced on the same press where mill finish is critical and 2) a higher metal removal is needed to attain a uniform etched finish.

This invention results from the inventors' discovery that control of the Cu content, and to a lesser degree also the Cr content, of the alloy can have a beneficial effect. The invention thus provides a population of billets resulting from more than one cast of metal having a specification such that every billet has a composition (in wt %):

| Constituent | Range | Preferred |
|---|---|---|
| Fe | <0.35 | 0.16-0.35 |
| Si | 0.20-0.6 | 0.4-0.6 |
| Mn | <0.10 | 0.01-0.05 |
| Mg | 0.25-0.9 | 0.35-0.6 |
| Cu | <0.015 | <0.010 |
| Ti | <0.10 | <0.05 |
| Cr | <0.10 | <0.09 |
| Zn | <0.03 | <0.03 |

A cast is defined as the process of converting a body of molten metal into a plurality of billets—often several hundred billets—of solid metal. The body of molten metal has a composition which is controlled to fall within a predetermined specification and which is generally given to the purchaser or user of the billet. The specification is maintained for more than one cast, generally for a whole series of casts. In the present invention the specification (which is not defined herein) is such that every billet has a composition within the ranges given above. A population of billets is an unspecified number, usually at least 50 and generally much more than 100, of billets resulting from more than one cast, usually a series of at least 5 and often more than 100 casts, of metal within the specification. A population according to the invention would not be expected to contain any billet having a composition outside the stated range.

Extruded sections are made by extruding billets taken from the population. Preferably the extruded sections are subjected to an alkaline etch and are then anodised. The invention also includes extruded sections so made.

The above alloys are within the 6000 series of the Aluminum Association classification and are related to AA6060 and AA6063 generally used to make extruded matt anodised sections.

Mg and Si combine to form dispersed $Mg_2Si$ particles which contribute to dispersion strengthening of the extruded sections. If Mg or Si concentrations fall below the stated ranges, then extruded sections may not achieve desired mechanical properties in the T5 or T6 temper. When the extruded sections are subjected to alkaline etch, the $Mg_2Si$ particles are preferentially dissolved. To some extent, this is advantageous in enhancing the desired mattening effect. But if the Mg and Si contents are too high, problems may arise with regard to ease of extrusion and surface quality obtainable. In some circumstances it is preferable that the Mg content be in the range 0.35-0.45%.

Fe is a preferred constituent of the alloy, partly because it contributes to the desired mattening effect and partly because alloys containing no Fe are much more expensive. When the Fe content is too high, problems arise as discussed above.

Mn is beneficial to the desired etch response and helps to counteract Fe by reducing pitting activity. Zn is notorious for the production of a bright spangled appearance. At high concentrations, Ti can give rise to streaking.

The level of Cu is controlled to be less than 0.015%, preferably less than 0.010%. As the experimental data below show, higher levels of Cu have a detrimental effect on matte finish and increase the rate of metal removal during etching. These very low Cu levels cannot be consistently achieved without positive and deliberate control over alloy composition.

The level of Cr is kept below 0.10% as is conventional. But an addition of Cr at a level of 0.03-0.09% may be made. As the experimental data below show, Cr at these levels enhances the matte response to etching but without increasing the metal removal rate.

The balance of the alloy is aluminium of commercial purity. This will normally be primary Al from a smelter, since it would not be easy to achieve tight compositional control of secondary Al from scrap. The invention is concerned with commercial scale production, and not with laboratory experiments using high purity samples.

In performing the invention method, an Al alloy of chosen composition is cast into a billet which is optionally homogenised and extruded into a section which is cooled. Homogenising conditions do not appear to have any material effect on the development of a matte surface. The extruded section may be cooled in still air or more preferably by forced air cooling or quenching.

The extruded section is preferably aged e.g. to T5 or T6 temper. This may be effected by heating the section at 150-200° C. for a time to develop peak strength. A preferred regime is 170-185° C. for 5-6 hours. Ageing has a material effect on mattness. It is believed that ageing grows $Mg_2Si$ particles and that these dissolve during alkaline etch to give a matt finish.

The extruded section is subjected to alkaline etching to develop a matte surface. Mention may be made of two commercially available etch systems:

Long-life etch is mainly used in Europe and North America, and involves treatment for 5-20 minutes with a solution of 100 g/l NaOH 100-160 g/l Al ion 30-50 g/l sequesterant e.g. Na gluconate or Na heptonate at 50-75° C. This typically results in 100 g/m$^2$ metal removal.

Recovery etch is mainly used in Japan and Canada, and involves treatment for 1-10 minutes with a solution of 30 g/l NaOH 50 g/l Al ion at 50-75° C. The weaker etch solution and shorter etch time results in a lower level of metal removal.

After etching, the extruded section has a matte surface. Although mattness is generally understood as the opposite of glossiness, its measurement is somewhat problematic and does vary substantially depending on the nature of the surface and of the treatment it is subjected to. Mattness may be measured by the test in BS 6161 at 60°. As a rough guideline, an Al surface that has been subjected to a long life etch may be regarded as matte if it has a gloss value below about 100; and an Al surface that has been subjected to a recovery etch may be regarded as matte if it has a gloss value below about 150.

Then the extruded and etched section is anodised under conditions which may be conventional and which form no part of this invention.

The ability to control etching response is important to ingot producers, extruders and finishers. The knowledge that two key parameters (Cu and Cr) have such a large influence is surprising. Armed with this knowledge, an ingot producer can control performance downstream when other factors are beyond its control.

Reference is directed to the accompanying drawings in which.

EXAMPLE 1

A series of alloys has been assessed by laboratory trials using commercial size dc ingot, a small extrusion press and controlled etching practices that simulate long life and recovery type caustic etches. The alloys had the composition (in wt %):

Si 0.45%

Fe 0.25%

Mg 0.41%

Zn 0.016%

Cr, Cu, Mn, each 0.001% unless stated

Balance commercial purity Al.

Figure 1:
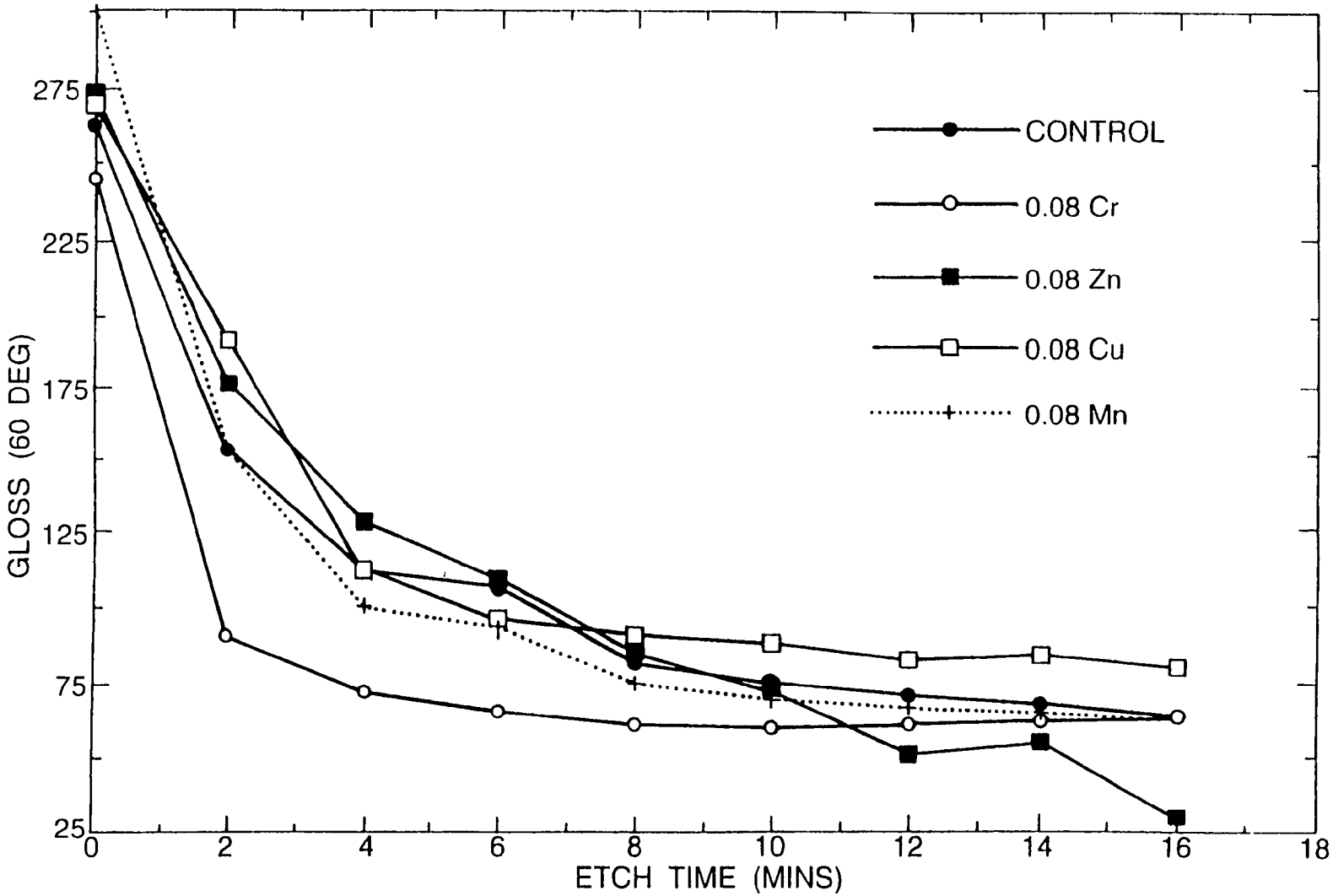
FIG. 1 is a graph of gloss measurement (BS 6161 at 60°) vs etch time for various alloys.
Figure 2:
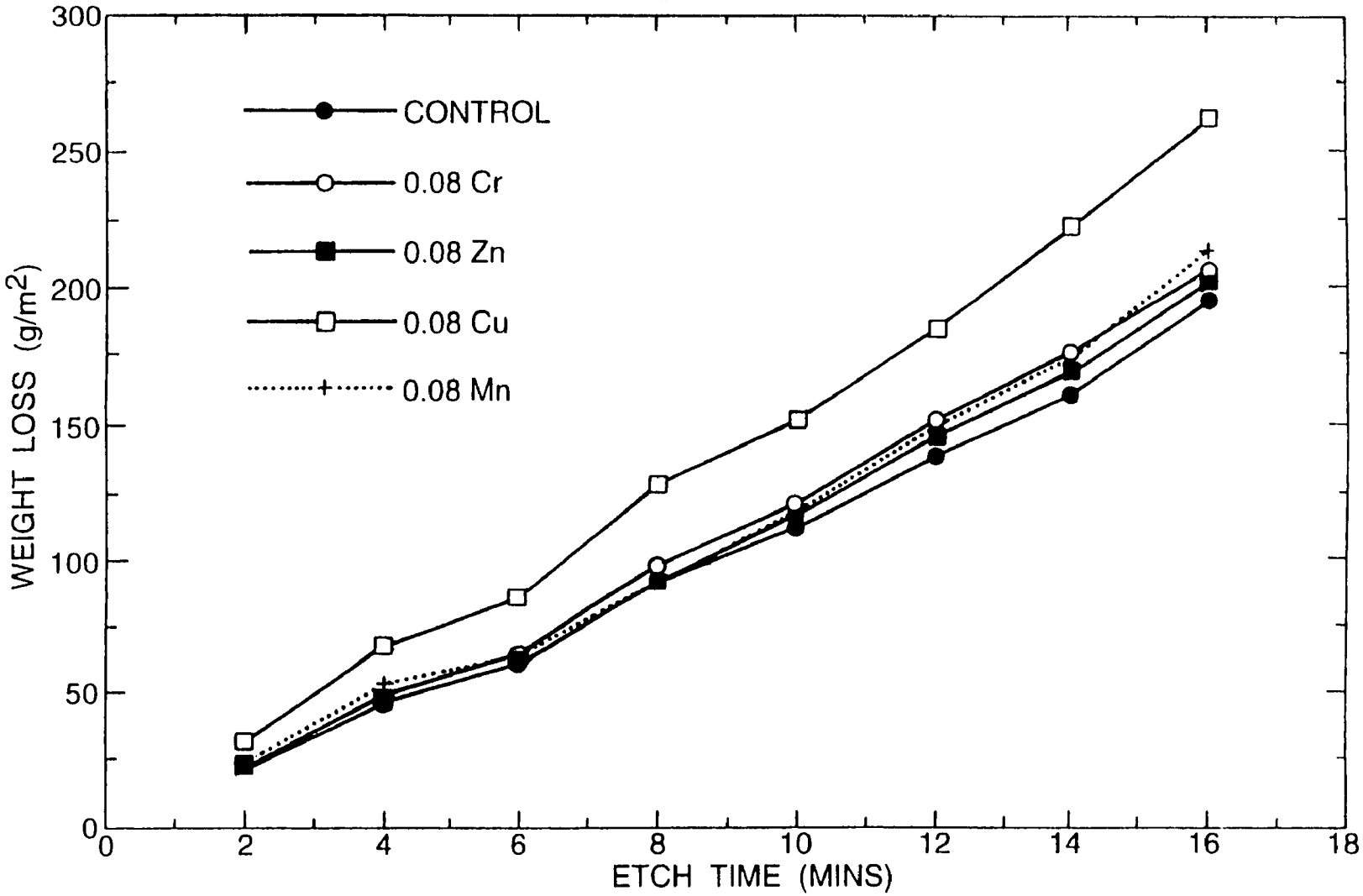
FIG. 2 is a graph of weight loss against etch time for the same alloys.

The results are shown in FIGS. 1 and 2. From a range of alloying conditions, all at 0.08%, the Cu in solid solution was seen to have detrimental effect on matte finish (FIG. 1) and to increase the metal removal rate by approximately 30% (FIG. 2).

EXAMPLE 2

Figure 3:
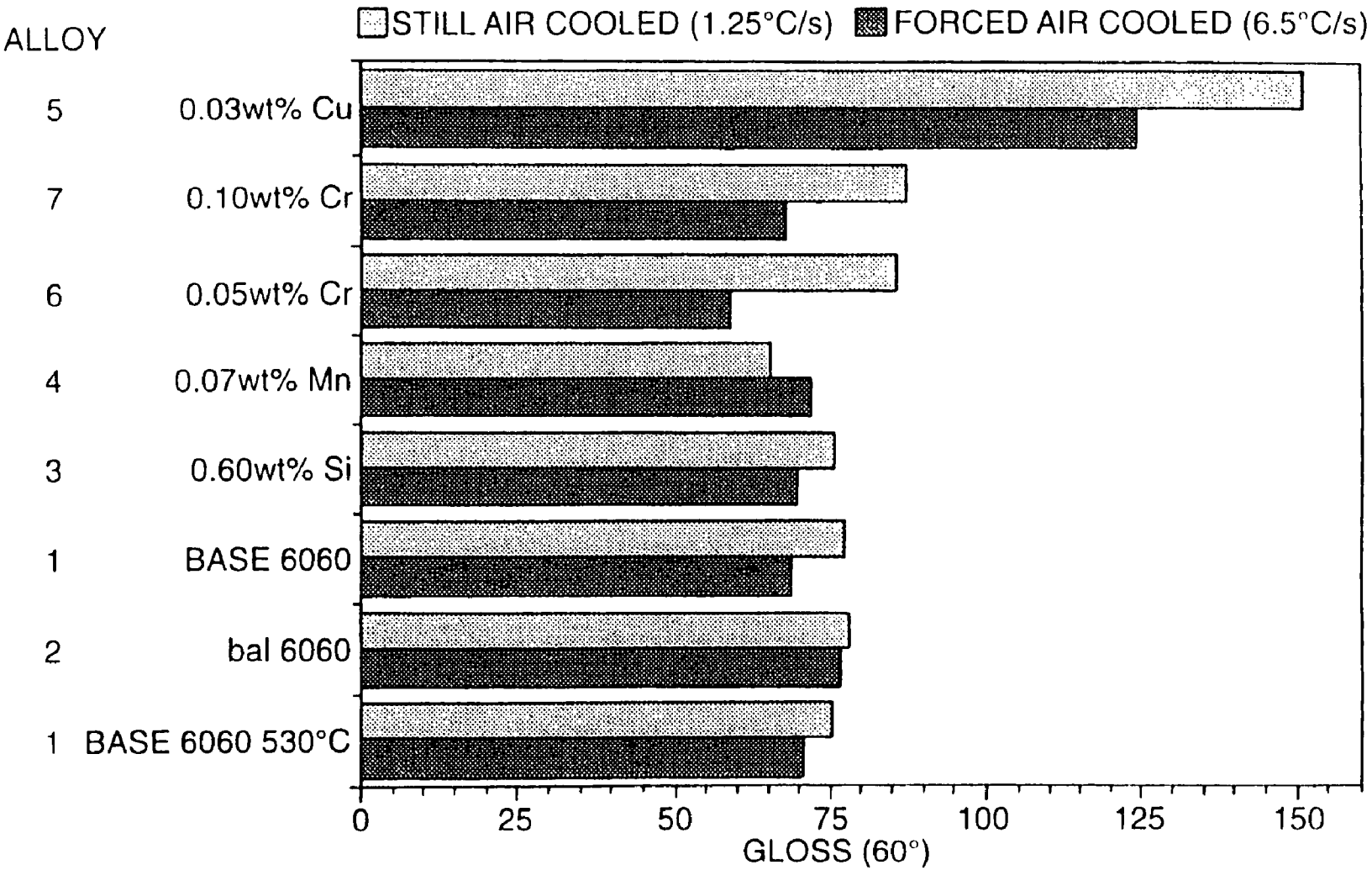
FIG. 3 is a bar chart showing the effect of composition and processing on matte response of various AA 6060 alloys after 12 minutes etch.
Figure 4:
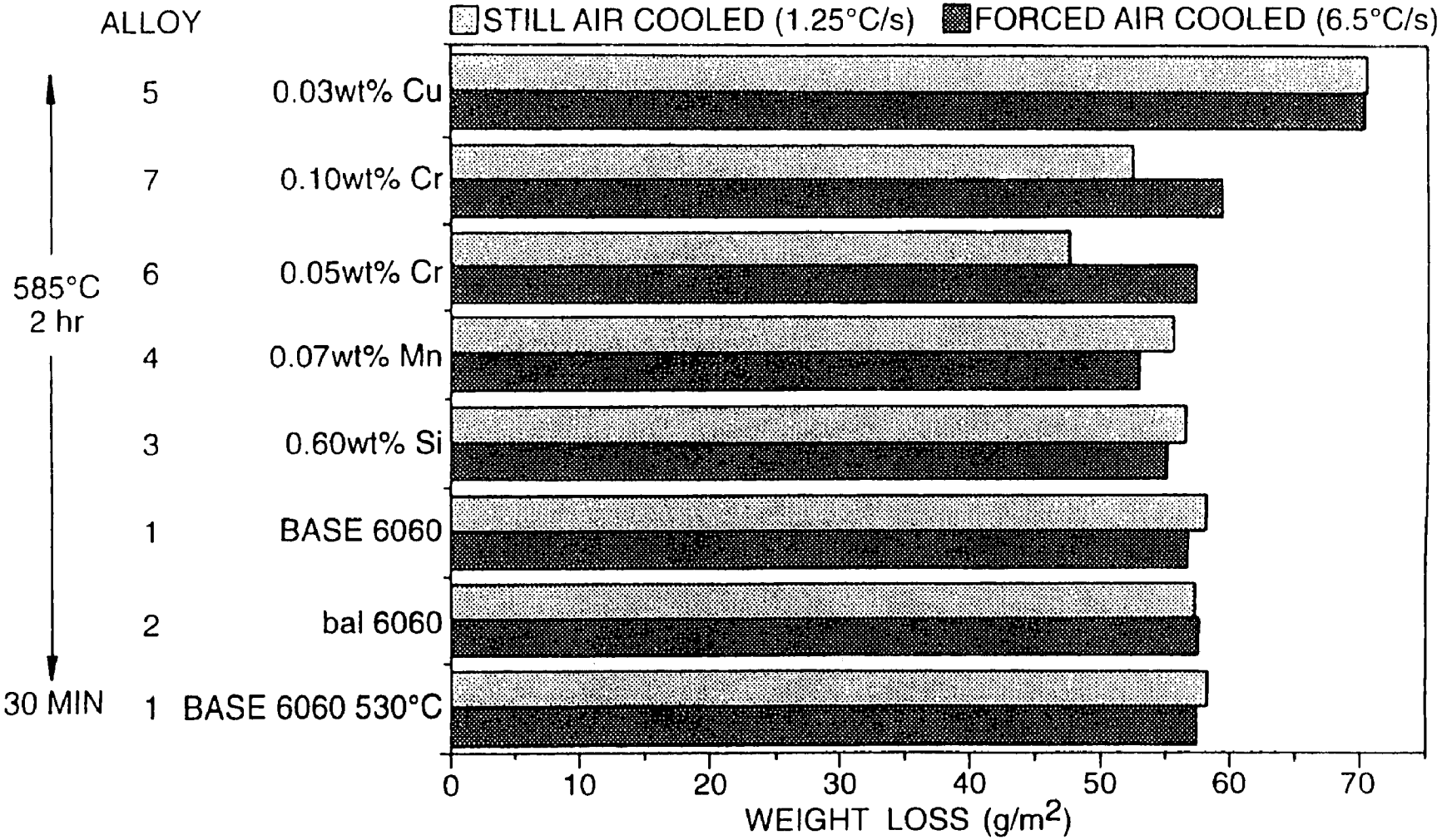
FIG. 4 is a bar chart showing the effect of composition and processing on weight loss of the same AA 6060 alloys after 12 minutes etch.

The alloys used in this study are set out in the Table below. Each alloy was dc cast into an ingot which was homogenised. Homogenisation was at 585° C. for two hours, in all cases except where indicated in FIGS. 3 and 4, where one ingot was homogenised at 530° C. for 30 minutes. The homogenised ingots were extruded to form extruded sections which were either still air cooled (1.25° C./s) or forced air cooled (6.5° C./s) and aged for 5 hours at 185° C. The extruded and aged sections were subjected to a long-life etch for 12 minutes at 60° C. The results of this trial are shown in FIGS. 3 and 4. As can be seen:

Homogenisation conditions have very little effect on either gloss or weight loss.

Forced air cooling has a minor but beneficial effect on mattness.

Cu at 0.03% has a major and detrimental effect, both on mattness (i.e. the etched product was more glossy) and on metal weight loss.

It is not known why the etching behaviour of these alloys is so sensitive to Cu level in solid solution when all previous work has indicated that the main parameters in the microstructure are coarse and fine particles. It is not envisaged that the Cu will play a part in the formation of dispersoids or ageing precipitates and thus must be in solid solution. One clue to the importance of solute elements can be gained from the general observation that the fine scale matrix attack dominates the etched surface.

| Sample | Alloy Composition % | | | | | | |
|---|---|---|---|---|---|---|---|
| No. | Si | Fe | Cu | Mn | Mg | Cr | Ti |
| 1 | .45 | .21 | .001 | .002 | .41 | <.001 | .011 |
| 2 | .30 | .19 | .001 | .002 | .42 | <.001 | 0.14 |
| 3 | .60 | .20 | .001 | .002 | .42 | .001 | .007 |
| 4 | .45 | .20 | .001 | .071 | .41 | .001 | .011 |
| 5 | .43 | .20 | .030 | .002 | .40 | .001 | .011 |

-continued

| Sample | Alloy Composition % | | | | | | |
|---|---|---|---|---|---|---|---|
| No. | Si | Fe | Cu | Mn | Mg | Cr | Ti |
| 6 | .45 | .20 | .001 | .002 | .40 | .050 | .010 |
| 7 | .45 | .20 | .001 | .002 | .40 | .103 | .011 |

Balance Al.

EXAMPLE 3

Figure 5:
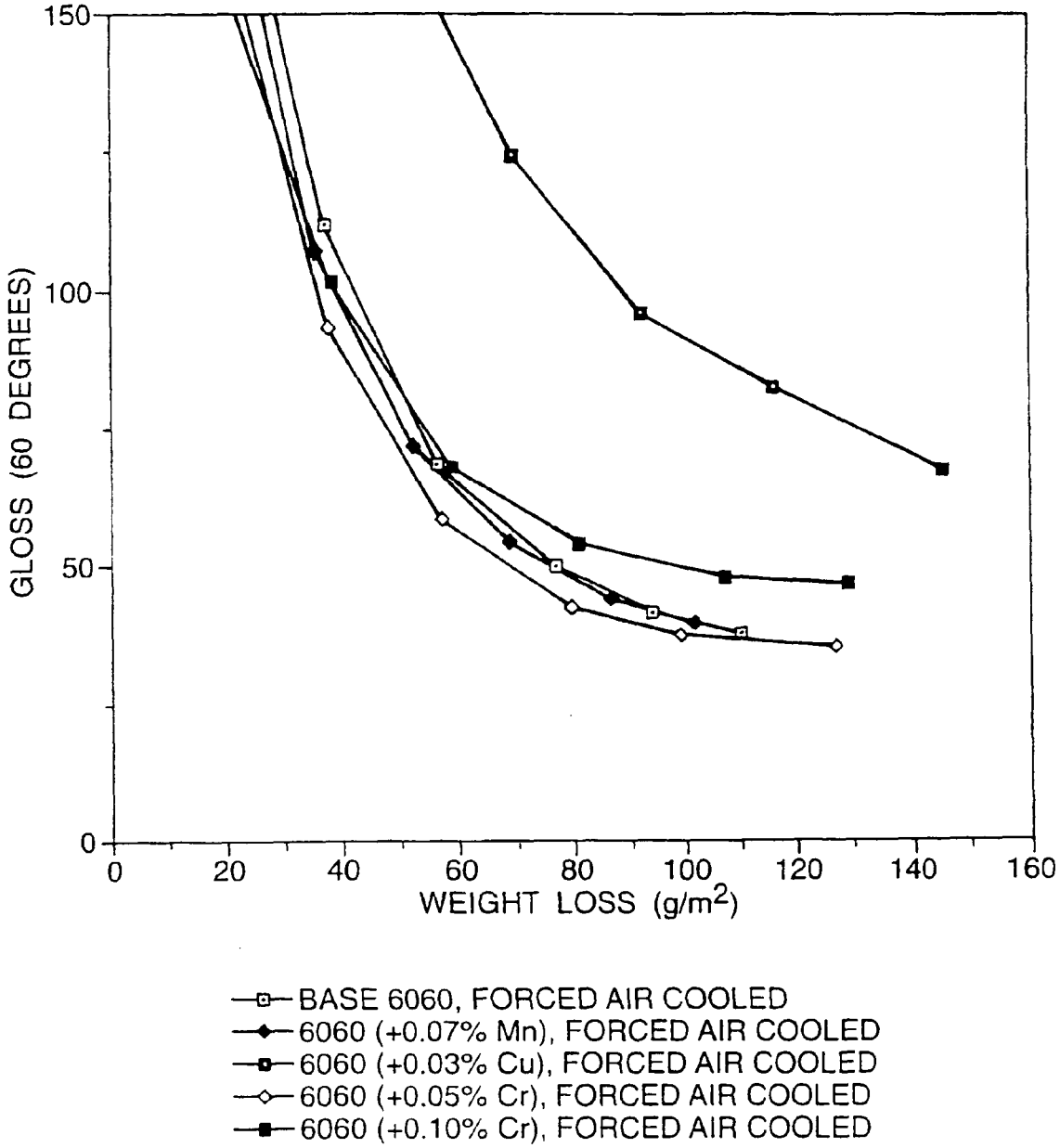
FIG. 5 is a graph of 60° gloss against weight loss, and shows the effect of alloying additions on the same forced air cooled AA 6060 alloys.

This example is based on the same trial and the same alloys as Example 2, but focuses on the effect of Cr. FIG. 5 shows that an alloy containing 0.05% added chromium gives a lower gloss level for a given metal weight loss in comparison with a base line alloy 6060 with no additional elements. Also included for comparison are the Cu variant, a Mn addition, and an alloy containing 0.10% Cr which does not have the same beneficial effect (samples 5, 4 and 7 in the Table).

Figure 6:
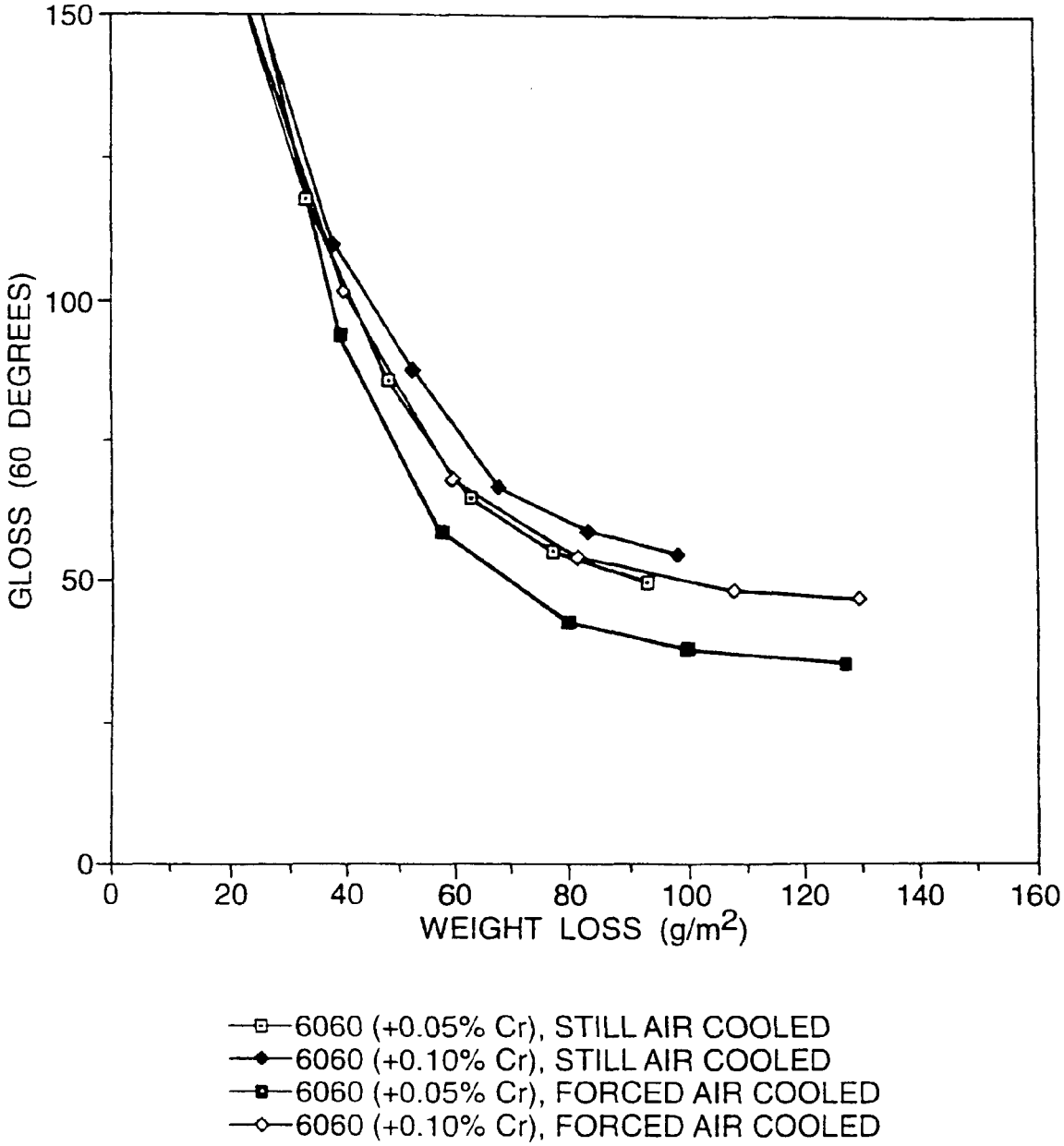
FIG. 6 is a graph of 60° gloss against weight loss, showing the effect of chromium level and cooling rate on gloss of the same AA 6060 alloys.

The difference between 0.05 and 0.10% Cr is also shown in FIG. 6, but in this case the effect of cooling rate after extrusion is also included. These data indicate that process conditions are important and this may well be linked to the precipitation of $Mg_2Si$ on to dispersoids when the cooling rate is too low.

Figure 7:
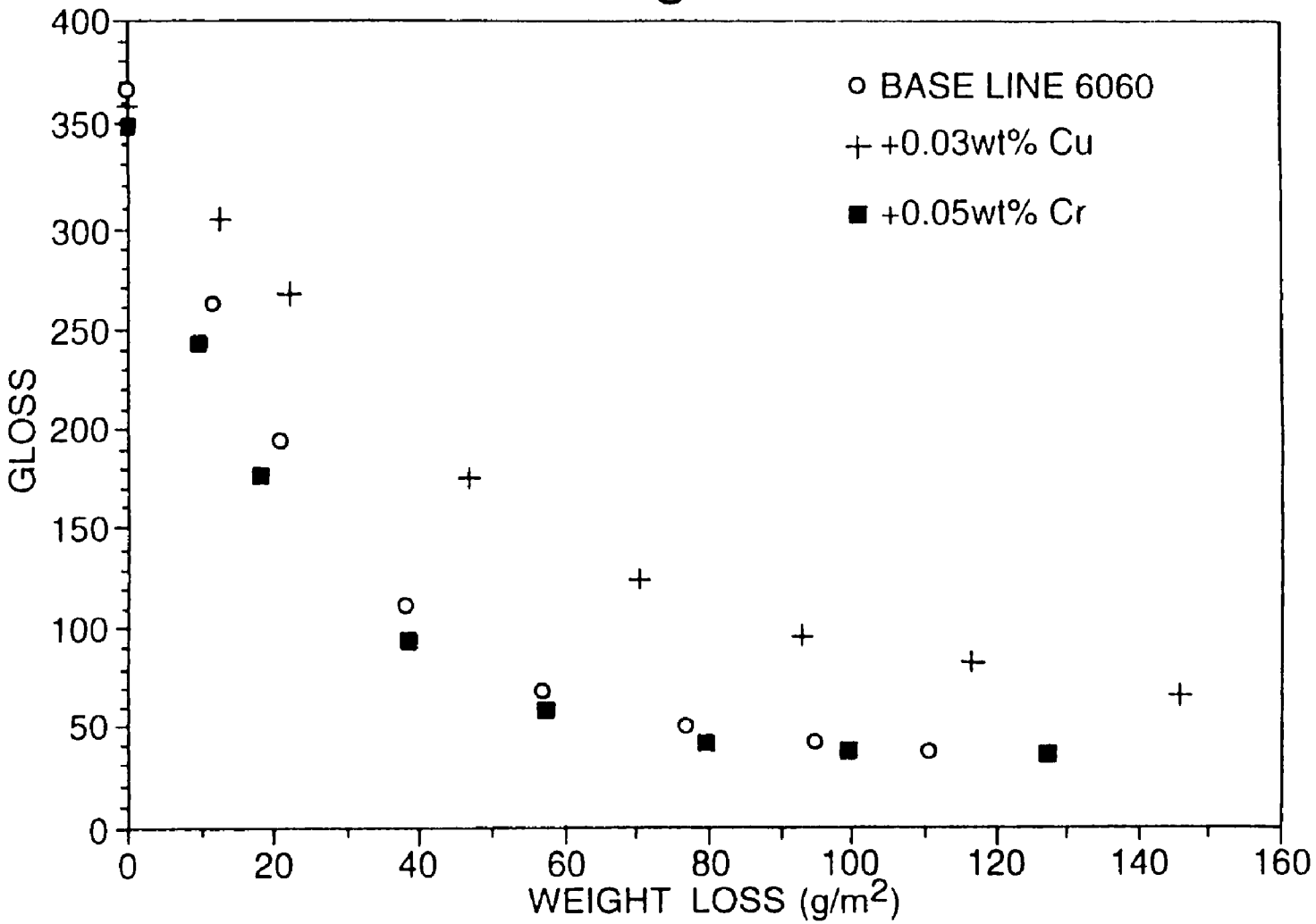
FIG. 7 is a graph of gloss against weight loss.

FIG. 7 is a graph of gloss against weight loss showing selected data from three of the alloys in the study. The detrimental effect of 0.03% Cu, and the beneficial effect of 0.05% Cr are clearly apparent.

EXAMPLE 4

AA6060 alloy ingots were produced in the laboratory by conventional DC casting with copper contents of 0.001, 0.006, 0.012, 0.016 and 0.03 wt %. The base alloy composition was 0.40 wt % Mg—0.44 wt % Si—0.20 wt % Fe—0.007 wt % Zn. The material was extruded, forced air quenched at the press and aged for 5 hrs @ 185° C. Samples were etched in a long life type etchant for incremental times up to 20 minutes. The gloss values were measured and the samples were weighed to give a value of metal removal rate.

Figure 8:
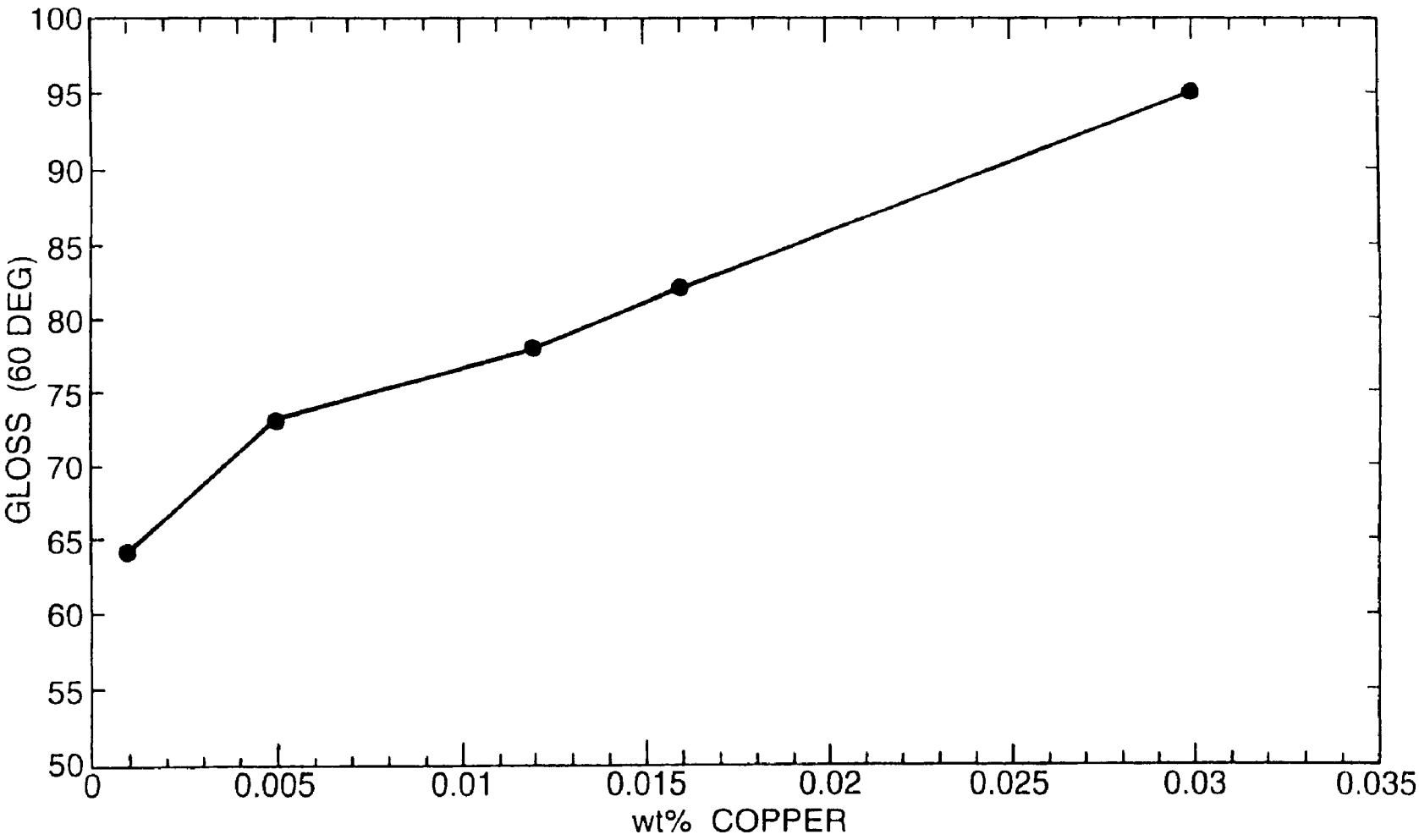
FIG. 8 is a graph of gloss against copper content.
Figure 9:
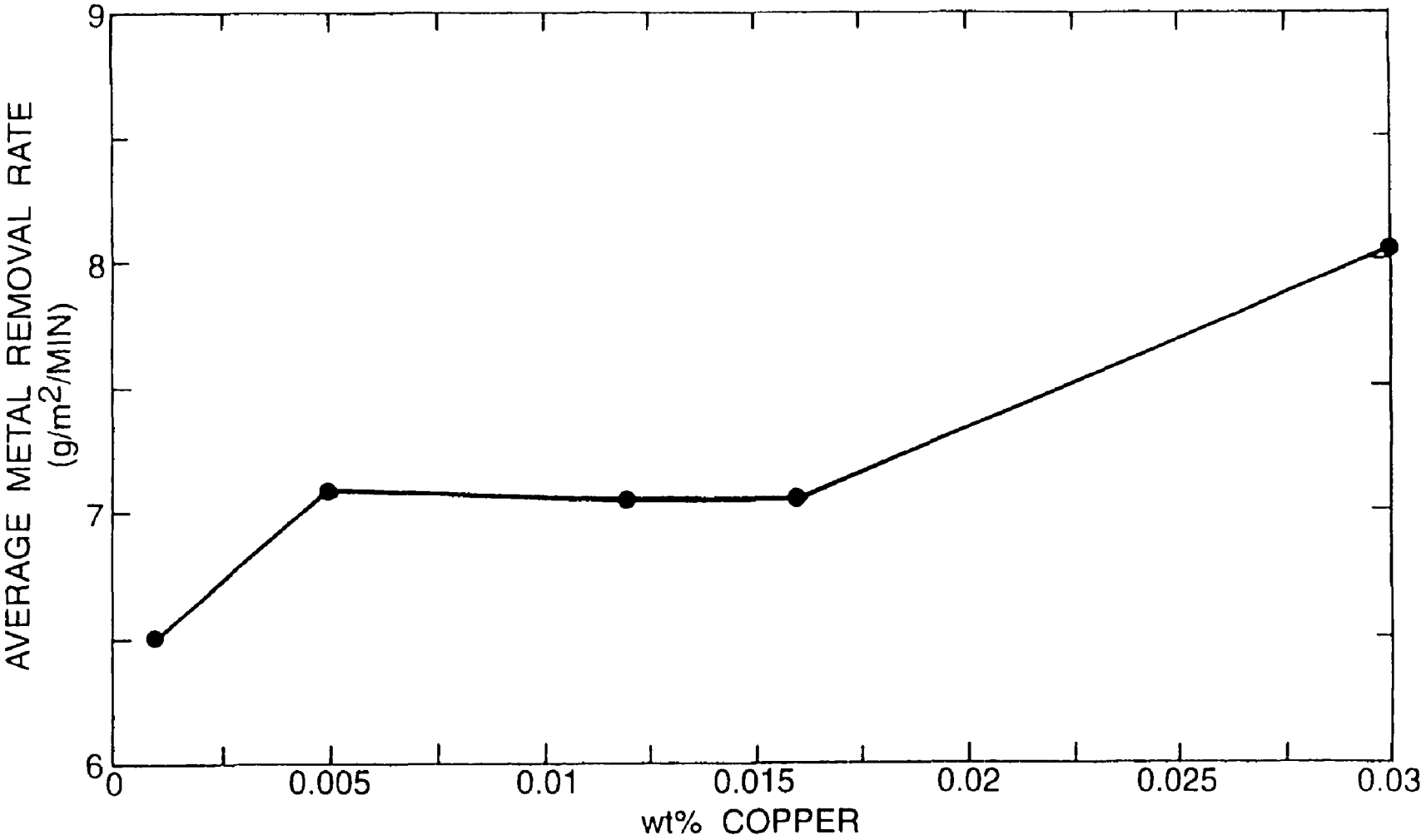
FIG. 9 is a graph of metal removal rate against copper content.
Figure 10:
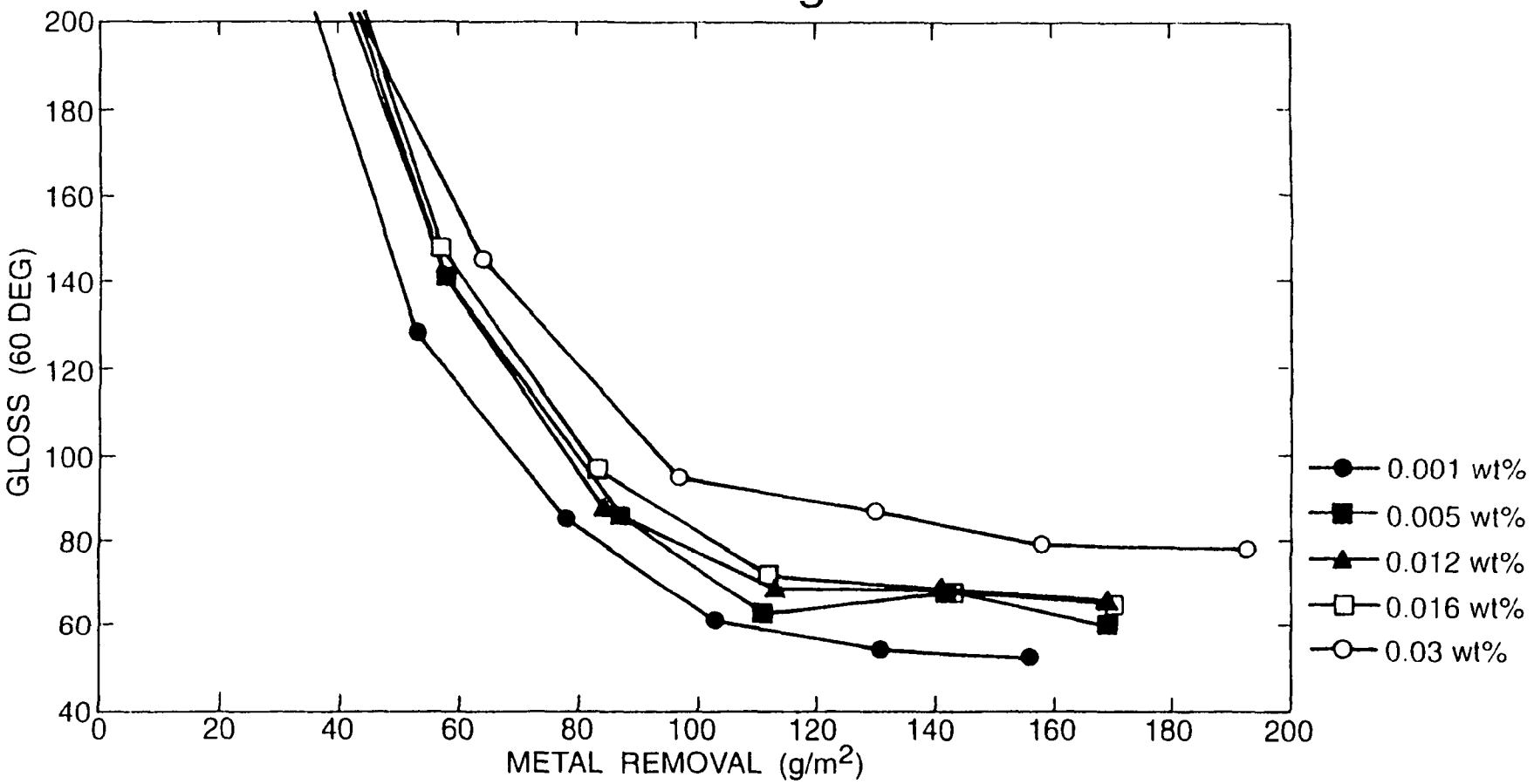
FIG. 10 is a graph of gloss against metal removal rate.

FIG. 8 shows the gloss level achieved with a typical metal removal figure of 100 g/m$^2$ as a function of copper content. The gloss level increases linearly with copper content within and beyond the inventive range. FIG. 9 shows the effect of copper content on the metal removal rate. The rate increases slightly above 0.001 wt % Cu but then levels off within the defined range before increasing again above 0.016 wt %. The lower metal removal rate associated with 0.015 wt % Cu or less is a useful feature as it means for a given etch time these alloys will undergo less aluminium dissolution and will therefore generate less etch sludge. The same data is presented in FIG. 8 as gloss vs. Metal removal. From this figure it is clear that the alloys within the defined range are more efficient in achieving a required gloss level. For example to achieve a gloss level of 80, less metal has to be removed for alloys containing <0.016 wt % as compared to the alloy containing 0.03 wt %.

EXAMPLE 5

Plant Trial

The following compositions were given identical homogenisation practices and extruded into the same profile:

Control:

0.46 wt % Si—0.20 wt % Fe—0.04 wt % Cu—0.39 wt % Mg—0.02 wt % Zn

Alloy within inventive range:

0.46 wt % Si—0.20 wt % Fe—0.01 wt % Cu—0.40 wt % Mg—0.02 wt % Zn.

Figure 11:
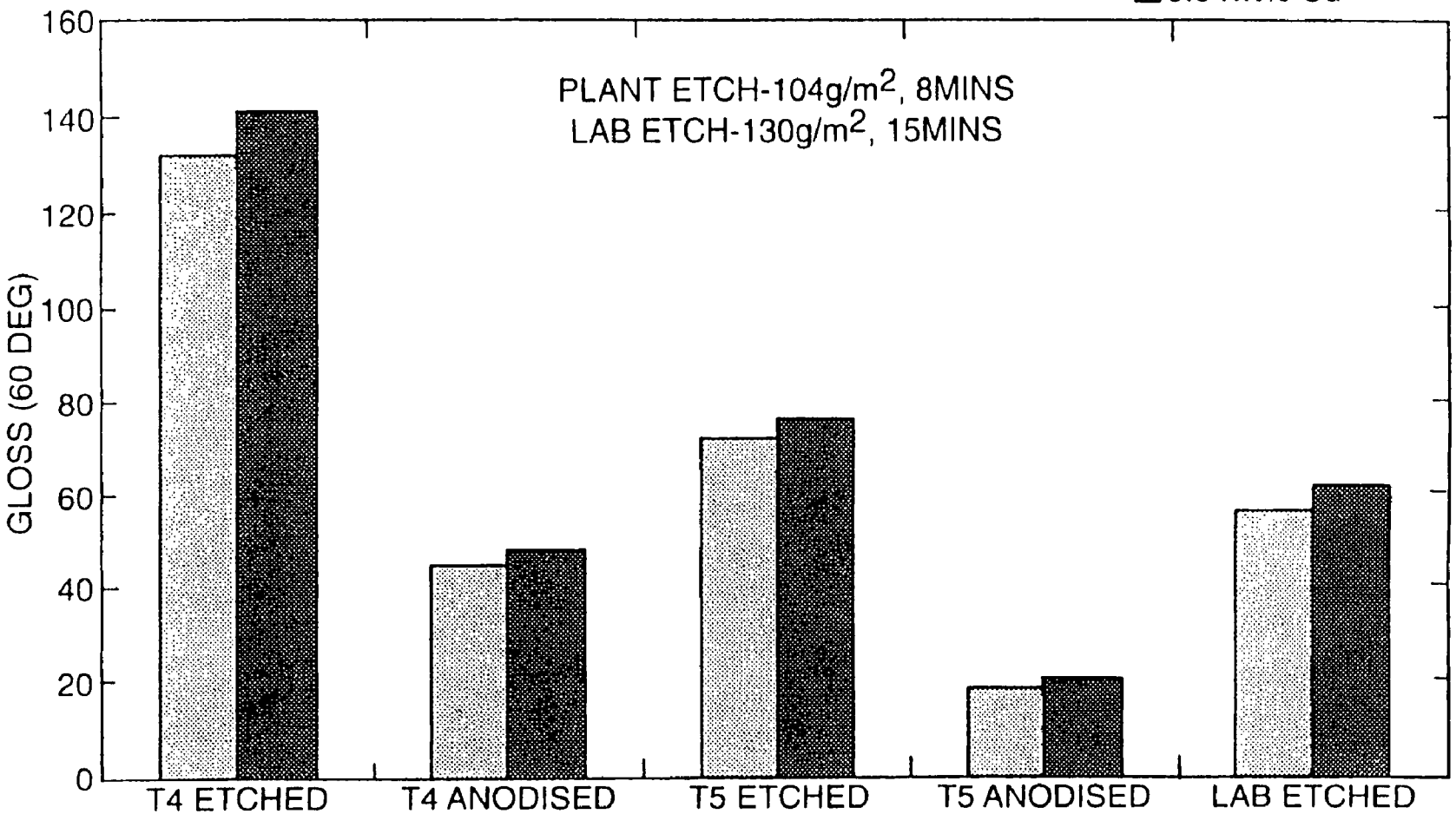
FIG. 11 is a bar chart comparing two different alloys under a variety of conditions.

Some material was left in the T4 temper and the remainder was aged to the T5 temper (6 hrs @ 185° C.). Lengths from both compositions and both tempers were etched and anodised within the same batch. The material was etched for 8 minutes to give a metal removal figure of 104 g/m$^2$. Some lengths were anodised to give a 5 micron anodic film. Samples were also given a 15 minute etch in the laboratory to give 130 g/m$^2$ metal removal. FIG. 11 summarises the gloss results. The low copper version consistently gave a lower gloss finish for both tempers and etches in the as etched and etched plus anodised conditions. These gloss trends corresponded to the visual appearance of the profiles.

EXAMPLE 6

Plant Trial

Two compositions were processed in this test

Control:

0.49 wt % Mg—0.47 wt % Si—0.23 wt % Fe—0.004 wt % Zn—0.02 wt % Cu

Alloy within inventive range:

0.38 wt % Mg—0.45 wt % Si—0.20 wt % Fe—0.015 wt % Zn—0.01 wt % Cu

Figure 12:
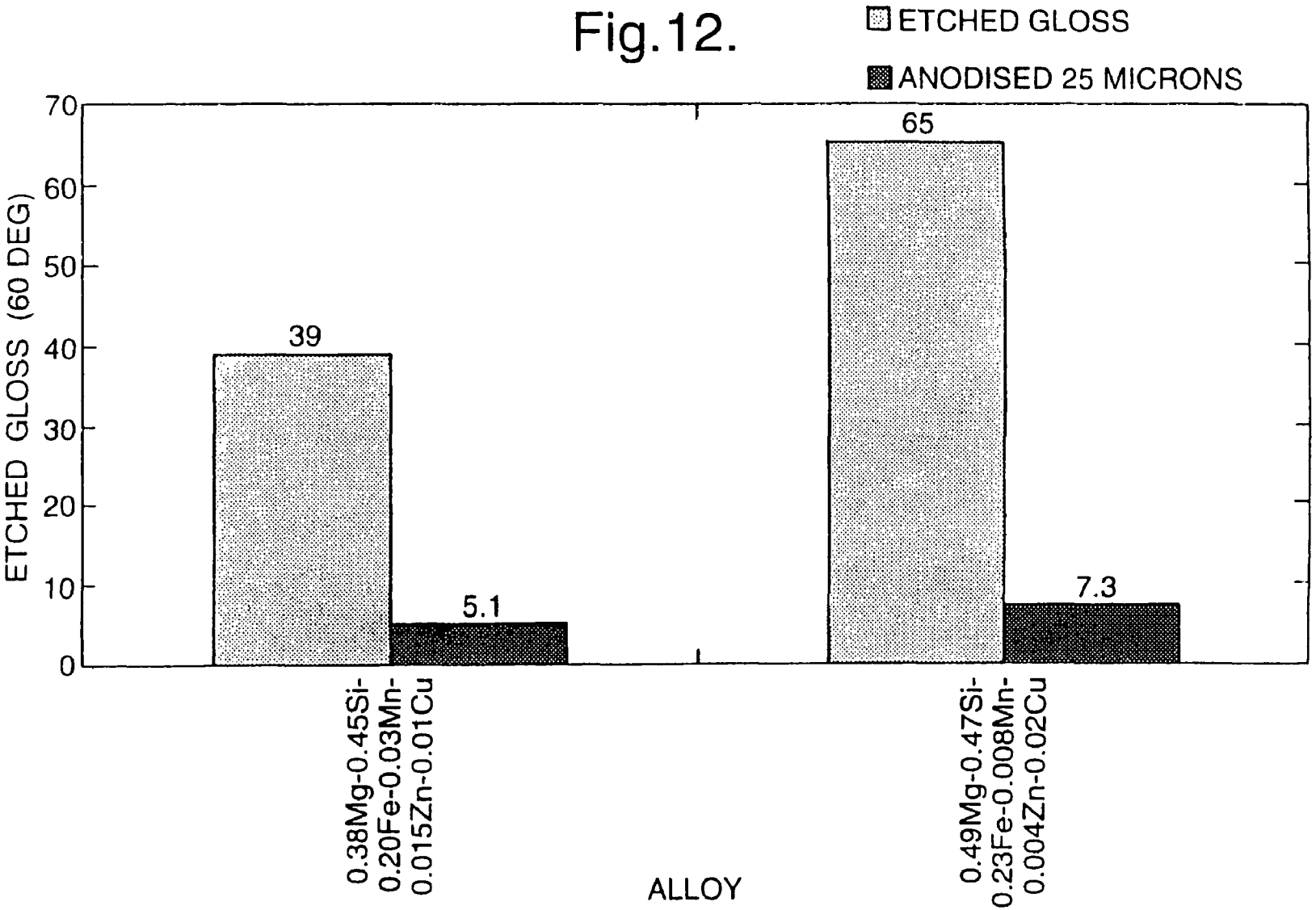
FIG. 12 is a bar chart comparing gloss of two different alloys under different conditions.

The two billets were extruded into the same profile under identical conditions and aged to the T6 temper. FIG. 12 shows the as etched gloss results obtained. The low copper variant gave a considerably lower gloss level in spite of the slightly lower Fe content, which is known to influence the final gloss achieved.

EXAMPLE 7

Effect of Ageing Practice

Figure 13:
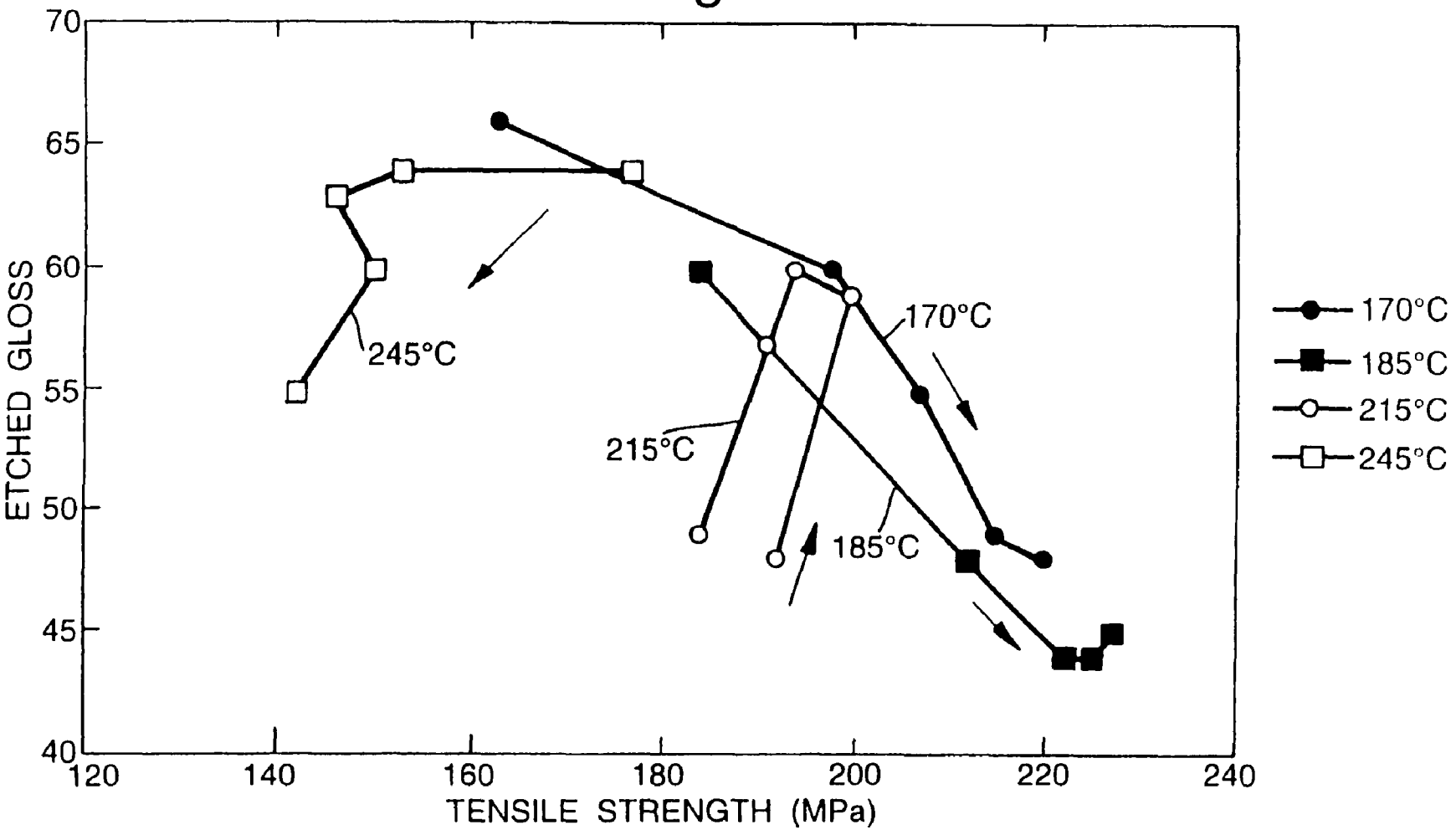
FIG. 13 is a graph showing the effect of ageing practice on gloss and tensile strength.

Laboratory tests have demonstrated that the final gloss level achieved is a very strong function of the ageing practice applied to the alloy. FIG. 13 shows the variation in etched gloss with tensile strength for a number of ageing temperatures. The various tensile strength values represent different heat treatment times at the various temperatures. The results indicate that the lower gloss values are achieved by ageing to full strength at 170 or 185° C. The results also explain some of the variability in the prior art on this subject.

COMPARATIVE EXAMPLE

Over a two-year period, 1242 casts of a variant of AA6060 were made from virgin smelter metal and recycled scrap. The AA6060 specification calls for a maximum of 0.10% Cu. When the Cu was controlled within the AA6060 specification, the following variation was found:

| Year | Number of Casts | Cu Content % Casts with <0.010% Cu | Cu Content % Casts with <0.015% Cu |
|---|---|---|---|
| 1 | 786 | 19.2% | 44.4% |
| 2 | 456 | 16.9% | 45.8% |

The variation in the Cu level in this population of billets is outside the present invention. Satisfactory extrusion and anodising performance was obtained but because of the variation in Cu level from one cast to another, it was not possible to reduce the amount of metal removed during etching and still obtain a uniform gloss level.

By controlling the purity of the virgin metal and the quality and amount or recycled scrap added to each cast, it is possible according to the invention to reduce the Cu level of all casts below 0.015 or 0.010% Cu to meet a tighter specification within the AA6060 composition.

The invention claimed is:

1. A method of producing a population of aluminum alloy billets comprising (a) performing more than one cast of metal wherein each cast of metal converts a body of molten metal comprising virgin metal and recycled scrap into a plurality of billets, while (b) controlling purity of virgin metal and quality and amount of recycled scrap in each cast such that all casts have a Cu level below 0.015 wt. %, and wherein said body has a composition within a specification such that every billet of the population has a composition (in wt %) consisting essentially of:

| Constituent | Range |
|---|---|
| Fe | <0.35 |
| Si | 0.20-0.6 |
| Mn | <0.10 |
| Mg | 0.25-0.9 |
| Cu | <0.015 |
| Ti | <0.10 |
| Cr | <0.10 |
| Zn | <0.03 |

balance Al of commercial purity.

2. A method as claimed in claim 1, wherein said population includes at least 50 billets.

3. A method as claimed in claim 1, wherein said population includes at least 100 billets.

4. A method of making an extruded section comprising (a) producing a population of aluminum alloy billets comprising (i) performing more than one cast of metal wherein each cast of metal converts a body of molten metal comprising virgin metal and recycled scrap into a plurality of billets, while (ii) controlling purity of virgin metal and quality and amount of recycled scrap in each cast such that all casts have a Cu level below 0.015 wt. %, and wherein said body has a composition within a specification such that every billet of the population has a composition (in wt %) consisting essentially of:

| Constituent | Range |
|---|---|
| Fe | <0.35 |
| Si | 0.20-0.6 |
| Mn | <0.10 |
| Mg | 0.25-0.9 |
| Cu | <0.015 |
| Ti | <0.10 |
| Cr | <0.10 |
| Zn | <0.03 |

balance Al of commercial purity; and (b) extruding a billet taken from said population of billets.

5. A method as claimed in claim 4, including the step of aging the extruded section by heating at 150°-200° C. for a time to develop peak strength.

6. A method as claimed in claim 4, wherein the extruded section is etched to develop a matte surface and then anodised.

7. A method as claimed in claim 4, wherein said population includes at least 50 billets.

8. A method as claimed in claim 4, wherein said population includes at least 100 billets.

9. A method of producing a population of aluminum alloy billets comprising (a) performing more than one cast of metal wherein each cast of metal converts a body of molten metal comprising virgin metal and recycled scrap into a plurality of billets, while (b) controlling purity of virgin metal and quality and amount of recycled scrap in each cast such that all casts have a Cu level below 0.010 wt. %, and wherein said body has a composition within a specification such that every billet of the population has a composition (in wt %) consisting essentially of:

| Constituent | Range |
|---|---|
| Fe | 0.16-0.35 |
| Si | 0.4-0.6 |
| Mn | 0.01-0.05 |
| Mg | 0.35-0.6 |
| Cu | <0.010 |
| Ti | <0.05 |
| Cr | <0.09 |
| Zn | <0.03 |

balance Al of commercial purity.

10. A method as claimed in claim 9, wherein said population includes at least 50 billets.

11. A method as claimed in claim 9, wherein said population includes at least 100 billets.

12. A method of making an extruded section comprising (a) producing a population of aluminum alloy billets comprising (i) performing more than one cast of metal wherein each cast of metal converts a body of molten metal comprising virgin metal and recycled scrap into a plurality of billets, while (ii) controlling purity of virgin metal and quality and amount of recycled scrap in each cast such that all casts have a Cu level below 0.010 wt. %, and wherein said body has a composition within a specification such that every billet of the population has a composition (in wt %) consisting essentially of:

| Constituent | Range |
|---|---|
| Fe | 0.16-0.35 |
| Si | 0.4-0.6 |
| Mn | 0.01-0.5 |
| Mg | 0.35-0.6 |
| Cu | <0.010 |
| Ti | <0.05 |
| Cr | <0.09 |
| Zn | <0.03 |

balance Al of commercial purity; and (b) extruding a billet taken from said population of billets.

13. A method as claimed in claim 12, including the step of aging the extruded section by heating at 150°-200° C. for a time to develop peak strength.

14. A method as claimed in claim 12, wherein the extruded section is etched to develop a matte surface and then anodised.

15. A method as claimed in claim 12, wherein said population includes at least 50 billets.

16. A method as claimed in claim 12, wherein said population includes at least 100 billets.

* * * * *